United States Patent [19]

Turk et al.

[11] Patent Number: 4,602,747

[45] Date of Patent: Jul. 29, 1986

[54] YARN WINDING APPARATUS AND METHOD

[75] Inventors: Herbert Turk, Remscheid; Herbert Schiminski, Hückeswagen, both of Fed. Rep. of Germany

[73] Assignee: Barmag Barmer Maschinenfabrik Aktiengesellschaft, Remscheid, Fed. Rep. of Germany

[21] Appl. No.: 733,596

[22] Filed: May 13, 1985

[30] Foreign Application Priority Data

May 12, 1984 [DE] Fed. Rep. of Germany ..... 3417693
Aug. 18, 1984 [DE] Fed. Rep. of Germany ..... 3430489
Mar. 26, 1985 [DE] Fed. Rep. of Germany ..... 3510903

[51] Int. Cl.[4] ..... B65H 67/048; B65H 54/42
[52] U.S. Cl. ..... 242/18 A
[58] Field of Search ..... 242/18 A, 25 A, 18 DD, 242/18 PW

[56] References Cited

U.S. PATENT DOCUMENTS 3,279,709 10/1966 Carlson et al. ..... 242/18 A
3,604,642 9/1971 Hirst et al. ..... 242/18 A
3,695,521 10/1972 Torii et al. ..... 242/18 A
3,825,206 7/1974 Schippers et al. ..... 242/18 A X
3,841,574 10/1974 Lenk et al. ..... 242/18 A X
3,856,222 12/1974 Wust ..... 242/18 A
3,913,852 10/1975 Lenk et al. ..... 242/18 A
3,999,715 12/1976 Schippers et al. ..... 242/18 A
4,106,710 8/1978 Schippers et al. ..... 242/18 A
4,145,010 3/1979 Turk et al. ..... 242/18 A
4,487,374 12/1984 Sugioka et al. ..... 242/18 A
4,505,436 3/1985 Schippers et al. ..... 242/43 A
4,505,437 3/1985 Schippers et al. ..... 242/43 A

FOREIGN PATENT DOCUMENTS 418917 2/1967 Switzerland ..... 242/18 A
1104156 2/1968 United Kingdom ..... 242/18 A

*Primary Examiner*—Stanley N. Gilreath
*Attorney, Agent, or Firm*—Bell, Seltzer, Park & Gibson

[57] ABSTRACT

The present yarn winding apparatus and method includes a yarn traversing mechanism, a pair of rotatably supported winding spindles, spaced apart main and auxiliary contact rolls, and a rotatable turret supporting said winding spindles in opposed relationship thereon. The turret rotates the winding spindles for successive movement into an operational position where one of the winding spindles is in engagement with the main contact roll and the other winding spindle is positioned out of engagement with both rolls and in position for yarn packages to be doffed therefrom. The turret also rotates the winding spindles into a yarn transfer position at which the winding spindle with full yarn packages thereon is in engagement with the auxiliary contact roll so that the yarn may be transferred from the full yarn packages to the empty tubes on the other winding spindle. In one embodiment, the spindles are rotatably driven by the contact rolls, and in another embodiment the contact rolls monitor the winding speed of the spindles and the spindles are rotatably driven by separate drive motors.

24 Claims, 4 Drawing Figures

YARN WINDING APPARATUS AND METHOD

This invention relates generally to an improved yarn winding apparatus and method for continuously advancing yarns to form yarn packages, and for doffing the packages without wasting yarn, and more particularly to a winding apparatus of the type in which a pair of winding spindles is supported on opposite sides of a rotatable turret so that the winding spindles are successively brought into a winding position and a doffing position.

A yarn winding apparatus of the described type, and which includes a pair of winding spindles supported on opposite sides of a rotatable turret and which are successively movable into contact with an auxiliary and a main friction drive roll is generally illustrated in German Pat. No. 23 64 284 and corresponding U.S. Pat. No. 3,999,715. These prior patents are concerned with the problem of "starting up" a winding spindle with empty tubes thereon during a package doffing operation. The disclosed apparatus includes an auxiliary friction drive roll positioned in advance of the main friction drive roll and the auxiliary friction drive roll is driven by a separate motor so that rotation of the empty tubes and winding spindle is initiated before the yarn is fed thereto. However, this solution is not completely satisfactory because the auxiliary friction drive roll imparts rotation to the spindle with the empty tubes for only a short period of time and must provide a high torque which is necessary to start the winding spindle with a great acceleration. Also, the auxiliary friction drive roll serves as a traversing roll and this creates problems because a complicated mechanism must be utilized in combining the functions of traversing the yarn and producing the high starting torque for the empty tubes in a short period of time.

A somewhat similar type of winding apparatus is disclosed in German Pat. No. 26 55 544 and corresponding U.S. Pat. No. 4,145,010. The auxiliary drive of this apparatus is engageable with the winding spindle before the winding spindle is rotated to its operating position in engagement with the main friction drive roll. In accordance with this patent, a second inverter is required for the drive of the auxiliary motor at such a speed that the winding spindle with the empty tube has the required surface speed.

With the foregoing in mind, it is an object of the present invention to provide an auxiliary contact roll which is required to produce only a slight torque because the auxiliary contact roll is positioned in a location following the position of the main contact roll and drives the winding spindle with the full packages wound thereon so that it does not require any accelerating torque. With the auxiliary contact roll positioned to engage the full package, any slackening of the yarn, as a result of slippage or an inadequate torque, will have no disadvantageous effect on the yarn during the yarn transfer which occurs in a matter of seconds. Since the main contact roll is continuously operated, it is suitable to produce the amount of torque required to start up the winding spindles with empty tubes and to transfer the torque to the empty tubes by frictional contact. Alternatively, the empty tubes and supporting spindle may be accelerated by an auxiliary drive as illustrated in U.S. Pat. No. 4,145,010, or by a motor permanently connected to the spindle, without slippage by relative movement between the tubes and a drive roll. Since the supporting spindle in this embodiment may be positioned very close to the main friction roll, it takes only a fraction of a second after transfer of the yarn to bring the empty tubes into contact with the main roll.

The winding apparatus of the present invention is inexpensive to produce, is reliable in operation, and requires very little space. The auxiliary contact roll of the present invention is directly mounted on the drive shaft of the drive motor and the main contact roll is driven from the same drive motor by means of a timing belt and pulleys. The diameter of the main contact roll corresponds to the diameter of the auxiliary contact roll when multiplied by the gear transmission ratio so that both contact rolls are rotated with the same surface speed, even though they actually have different diameters. The drive shaft of the drive motor is preferably positioned parallel to and spaced from the main contact roll so that the shaft end adjacent the timing belt is positioned in the same normal plane as the pulley end of the main contact roll. The other end of the drive shaft of the motor terminates approximately in the longitudinal center area of the main contact roll, while the auxiliary contact roll, which is mounted on this other end, extends only over such longitudinal center area of the main contact roll. In many instances, two yarn packages are wound in adjacent positions on one winding spindle. In such an instance, the auxiliary contact roll, which is supported in the longitudinal central area of the main contact roll, engages the neighboring ends of adjacent yarn packages on the winding spindle.

In one embodiment of the invention, the winding spindles and packages are driven by means of the contact rolls. More particularly, one drive motor is provided for driving the two contact rolls, and the main and auxiliary contact rolls are provided with means for providing a constant and identical peripheral speed to the packages. The one common drive motor produces the necessary torque to drive the packages. However, in another embodiment, the auxiliary and main contact rolls are used in a winding apparatus in which each winding spindle is driven by a separate drive motor. In this instance, the contact rolls serve to measure the circumferential speed of the packages and to control the speed of the winding spindle drive motors at such a speed that the circumferential speeds of the packages are maintained at a substantially constant value. This is particularly true with a greater accuracy in the phase of the package doff, when, as is further preferred, a servomotor is employed to drive the contact rolls with an input which substantially corresponds to the no-load output of the friction rolls. This drive is operated at such a speed that the circumferential speed of the contact rolls is identical with the nominal circumferential speed of the package. In this instance, the winding spindle with the empty tubes is brought into engagement with the main contact roll after this winding spindle reaches a rotational surface speed which corresponds with the surface speed of the main contact roll. For measuring the circumferential speed of the packages and maintaining it constant, a measuring device is provided which preferably measures the power consumption, torque or current of the servomotor, the output of which is alternately fed via switches to one of the two spindle drive motors.

Other objects and advantages will appear as the description proceeds when taken in connection with the accompanying drawings, in which FIG. 1A is a somewhat schematic vertical sectional view of one embodiment of the present winding apparatus, with the winding spindles in the position they occupy during a yarn transfer operation;

Figure 1B:
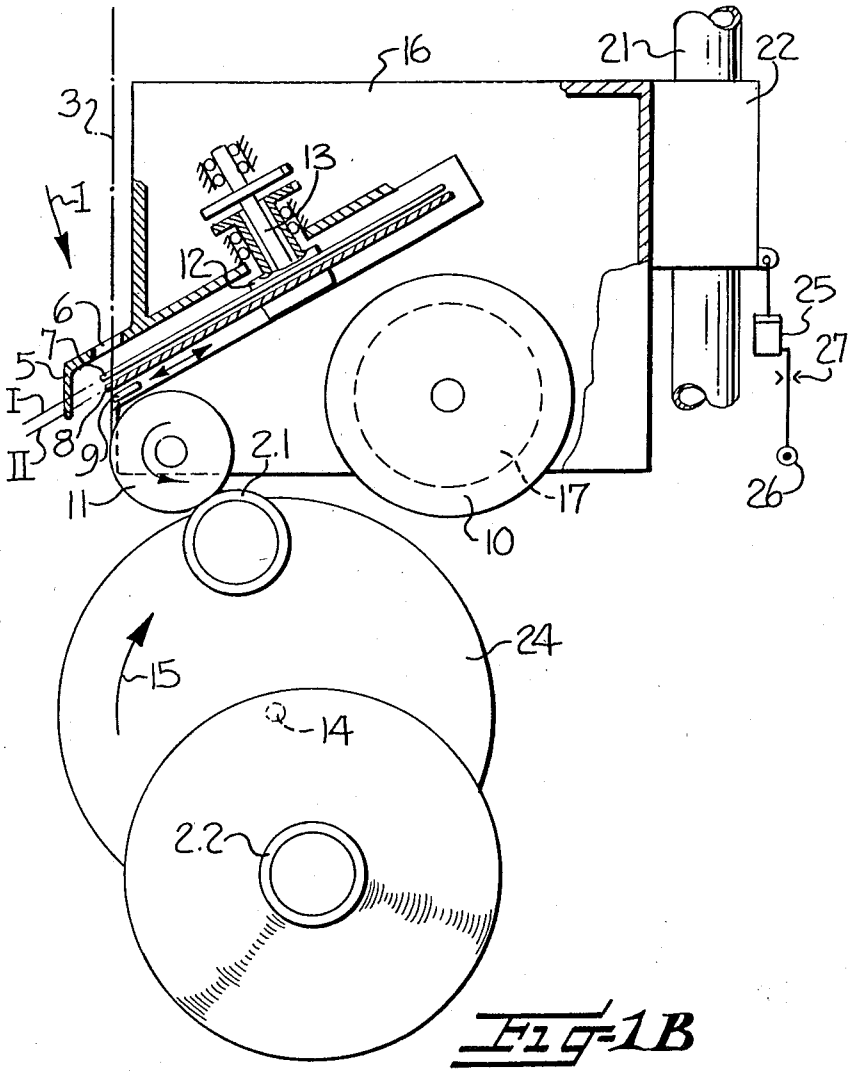
FIG. 1B is a view similar to FIG. 1A but showing one winding spindle being rotated at the normal winding position and with the other winding spindle in position to be doffed.
Figure 1A:
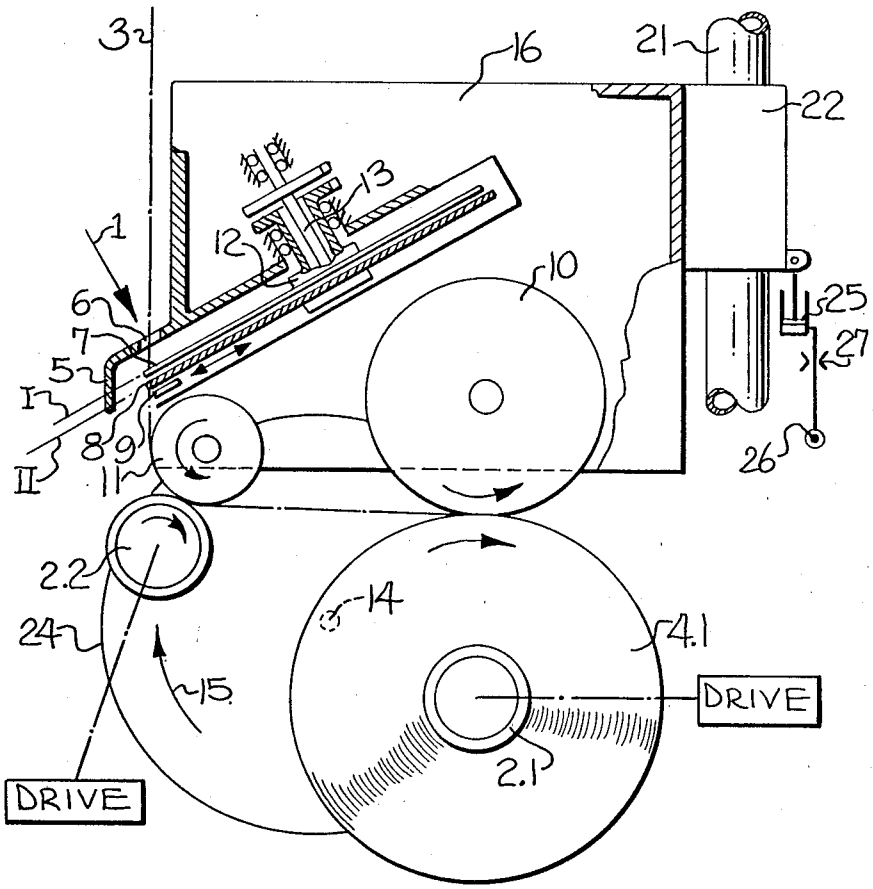
Figure 2:
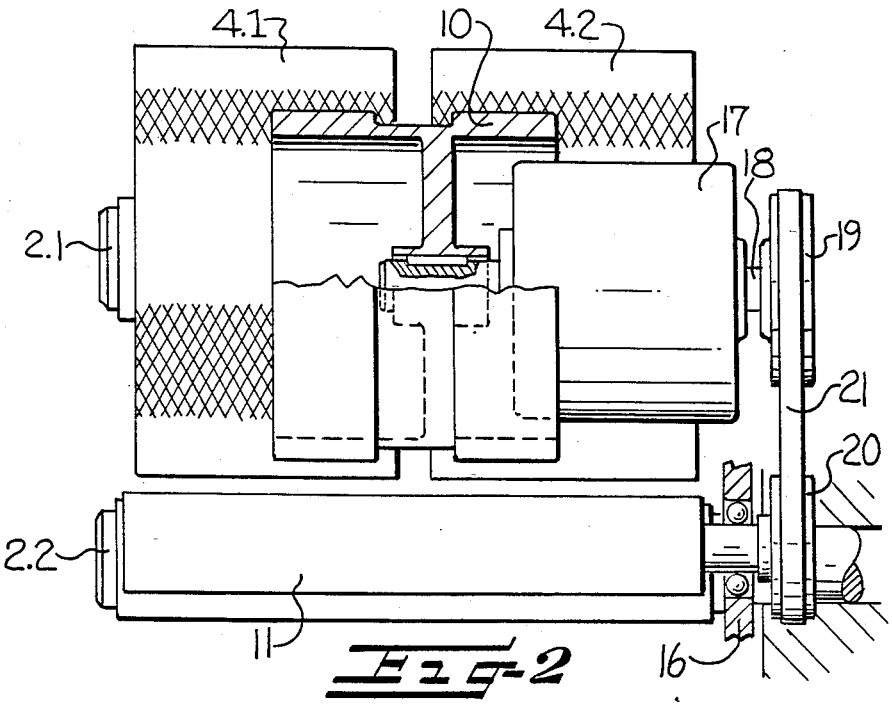
FIG. 2 is a somewhat schematic plan view looking downwardly on the main and auxiliary contact rolls of FIG. 1A, with portions in section.

As illustrated in FIGS. 1A, 1B, and 2, two spaced-apart yarns, indicated by the dash-dot lines 3 in FIGS. 1A and 1B, are advanced through a yarn traversing mechanism, broadly indicated at 1, to be wound onto either a winding spindle 2.1 or 2.2 to form adjacent yarn packages 4.1 and 4.2 (FIG. 2) in side-by-side relationship on empty bobbin tubes placed on the winding spindles 2.1 and 2.2. The yarn traversing mechanism 1 may be of any desired type and is illustrated as being of the type including a two-arm, three-arm or four-arm rotary blade 7 which is driven in an upper plane of rotation I by a rotor 12. A rotary blade 8 is driven in an opposite direction from the blade 7 by a drive shaft 13 and rotates in a lower plane II. Each yarn 3 is traversed across the yarn package in one direction by the arms of blade 7 and traversed in the other direction by the arms of the blade 8 and both yarns are directed along a guide edge 9. A guard cover 5 extends above the traversing blades 7, 8 and is provided with an elongate slot 6 through which the yarns 3 pass. Further details of a traversing mechanism of this general type may be obtained by reference to U.S. Pat. No. 4,505,437.

The winding spindles 2.1, 2.2, with the packages 4.1, 4.2 or the empty tubes placed thereon, are driven, when in their operating or winding position, by circumferential contact with a main contact roll 11 (FIG. 1B) and, when in their yarn transfer or intermediate position (FIG. 1A) by an auxiliary contact roll 10. The winding spindles 2.1, 2.2 are rotatably supported on opposite sides of a turret 24 which is supported to rotate about a center 14 and in a clockwise direction, as indicated by the arrow 15 in FIGS. 1A, 1B. The yarn traversing mechanism 1 and the contact rolls 10, 11 are supported on a vertically movable support slide housing 16. Bushings 22 are fixed on the slide housing 16 and supported for vertical sliding movement on a guide post 21. One or more pneumatic cylinders, schematically illustrated at 25, are connected to the bushing 22 and are supplied from a source of pressure 26 through a throttle 27 and a valve, not shown. The pneumatic cylinder 25 partially absorbs the weight of the slide housing 16 and the parts carried thereby during operation and also operates to move the slide housing 16 upwardly and downwardly. Because of the resilient support of the slide housing 16, the main contact roll 11 can be raised upwardly as the package diameter increases in size during operation without it being necessary to rotate the turret 24.

The drive arrangement for the contact rolls 10, 11 is illustrated in FIG. 2 with the takeup apparatus in the yarn transfer or intermediate position, as illustrated in FIG. 1A. In this intermediate position, winding spindle 2.2 with the empty tubes placed thereon is in circumferential contact with the main contact roll 11 while the winding spindle 2.1 with the two packages, 4.1 and 4.2 wound thereon, is in circumferential contact with the auxiliary contact roll 10. A synchronous electric drive motor 17 (FIG. 2) is supported on the slide housing 16 with opposite ends of its drive shaft 18 extending outwardly therefrom and parallel to the axes of rotation of the main contact roll 11 and the auxiliary contact roll 10. The motor 17 imparts driving rotation to both the main contact roll 11 and the auxiliary contact roll 10.

The main contact roll 11 is rotated by means of a drive pulley 19 fixed on one end of the motor drive shaft 18, a drive pulley 20 fixed on the drive shaft of the main contact roll 11, and a timing belt 21 in engagement with the drive pulleys 19, 20. The drive motor 17 and the other end of the drive shaft 18 extend inwardly to a position approximately half the length of the main contact roll 11 and fixedly supports the auxiliary contact roll 10 in driving relationship thereon. As will be noted in FIG. 2, the auxiliary contact roll 10 is substantially in the form of a sleeve having a larger diameter than the housing of the motor 17 and, depending on the length of the motor 17, one end portion of the auxiliary contact roll 10 encircles a portion of the inner end of the housing of the motor 17. Also, the width of the drive surface of the auxiliary contact roll 10 is shorter than the length of the winding spindles 2.1, 2.2 and the respective yarn packages 4.1, 4.2 so that the auxiliary contact roll 10 contacts the packages 4.1, 4.2 only in their adjacent end portions (FIG. 2).

The operation of the takeup apparatus will be described beginning with the turret 24 rotated to the normal winding operation position, as shown in FIG. 1B. In this normal winding operation position, the winding spindle 2.1 with the empty bobbin tubes placed thereon, is resting against the circumference of the main contact roll 11 and is driven thereby. The other winding spindle 2.2, with the filled yarn packages 4.1, 4.2 thereon is in a lower doffing position and the filled packages may be removed from the winding spindle 2.2 and replaced with empty tubes in a suitable doffing operation. As the yarns 3 are wound onto the winding spindle 2.1, they form gradually increasing diameters of yarn packages and the increasing yarn packages are rotated by the main contact roll 11, and the slide housing 16 and the corresponding parts are raised upwardly along the guide post 21 as the yarn packages increase in diameter. When the packages have reached their desired diameter the winding cycle is completed, or in the event of an operational breakdown, the turret 24 rotates in the direction of the arrow 15 while the slide housing 16 is lowered and the main contact roll 11 comes into contact with the winding spindle 2.2 with the empty tubes thereon while the auxiliary contact roll 10 moves into driving contact with the outer circumference of the packages 4.1, 4.2, as shown in FIGS. 1A and 2. This phase of the operation will be referred to as the transfer phase with the yarns 3 being further wound onto the packages 4.1, 4.2 and the auxiliary contact roll 10 temporarily driving the yarn packages. At the same time, the winding spindle 2.2, with the empty tubes placed thereon, is being rotated by the main contact roll 11 so that the surface speed substantially corresponds to that of the main contact roll 11 and the yarn speed. In this manner, the main contact roll 11 serves to start up and accelerate the winding spindle 2.2 to a peripheral speed which corresponds to the speed of the advancing yarn, and prior to transferring yarn thereto.

It is preferred at each of the winding spindles 2.1, 2.2 have separate drive motors directly connected thereto. These drive motors, shown schematically in FIG. 1A, are operated as a winding spindle approaches the main contact roll 11 to impart at least a substantial portion of the required circumferential speed to the corresponding winding spindle as it approaches and is contacted by the main contact roll 11. With this arrangement, the time during which the turret is rotated may be used to increase the speed of the winding spindle as it approaches the main contact roll 11.

Conventional yarn transfer devices, not shown, for example of the type described in German Pat. Nos. 23 64 284 and 24 61 223, and U.S. Pat. Nos. 3,999,715 and 4,114,361, operate so that the yarn being wound on the packages 4.1, 4.2 is parted and placed on the empty tubes on the winding spindle 2.2 to begin the formation of new yarn packages thereon. Turret 24 is again rotated in a clockwise direction to a position which is 180 degrees opposite to that shown in FIG. 1B. During the winding or operating phase, as shown in FIG. 1B, the auxiliary contact roll 10 continues to rotate but is out of frictional driving engagement with either of the winding spindles 2.1, 2.2.

The main contact roll 11 has a smaller diameter than the auxiliary contact roll 10 and operates at the proper speed to insure the proper feeding of the yarn to form the yarn packages as the yarn is traversed back and forth by the traversing mechanism 1. On the other hand, the auxiliary contact roll 10 has a larger diameter than the housing of the drive motor 17 so that the outer end portion of the roll 10 can encircle and enclose a portion of the housing of the drive motor 17. To insure that the circumferential speeds of the main contact roll 11 and the auxiliary contact roll 10 are substantially identical, the ratio of the diameter of the auxiliary contact roll 10 to the diameter of the main contact roll 11 is equal to the ratio of the diameters of the respective drive pulleys 19, 20.

Figure 3:
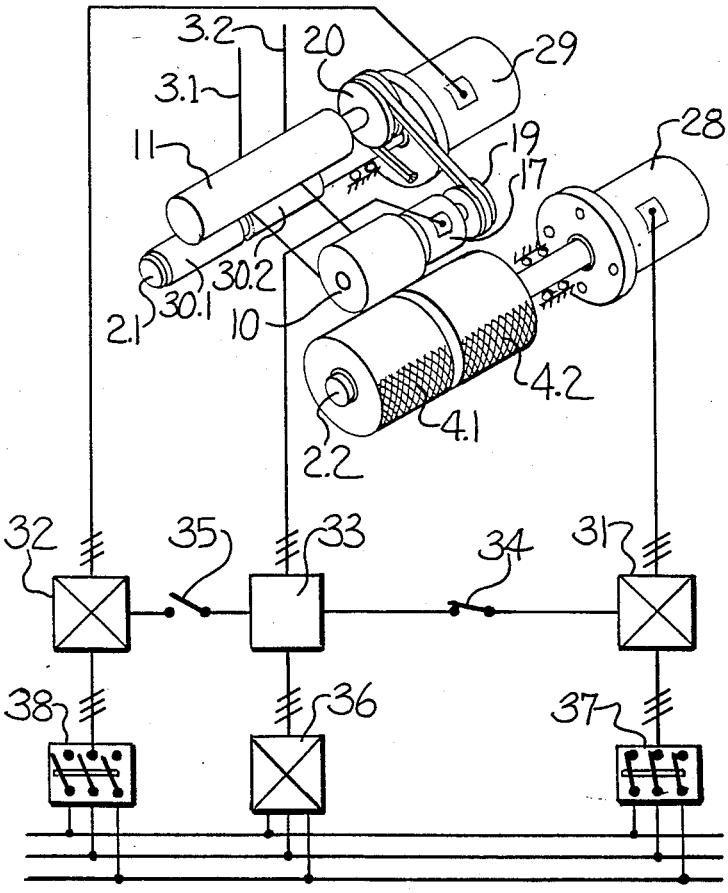
FIG. 3 is a schematic perspective view of another embodiment of the present invention.

Another example of a winding apparatus embodying the present invention is shown in FIG. 3. In this figure, the traverse device as shown in FIGS. 1A and 1B has been omitted for better illustrating those parts which are essential for this embodiment. However, one of the parts of the traverse device is the contact roll 11, which is also shown in FIG. 3. The contact roll 11 serves to guide the yarn between the traverse device and the package and to shorten the lag between the point where the yarn first contacts the package and the actual position of the traverse device. FIG. 3 also does not illustrate the machine frame of the winder and the rotatable turret for rotatably mounting the winding spindles 2.1 and 2.2, and reference is made to FIGS. 1A and 1B for an illustration of these components.

FIG. 3 illustrates the spindles 2.1 and 2.2 in the yarn transfer position, and wherein the winding spindle 2.1, and the empty tubes 30.1 and 30.2 mounted thereupon, are positioned closely adjacent but spaced from the roll 11. The winding spindle 2.2 and the full packages 4.1 and 4.2 are shown in the last phase of the winding cycle, and during this phase, the yarns 3.1 and 3.2 are transferred from the full packages to the empty tubes 30.1, 30.2. Also in this phase, the winding spindle 2.2 is driven by a coaxial drive motor 28. The motor 28 is a three-phase motor connected to the frequency converter 31, and the output frequency of converter 31 is controlled to maintain the peripheral speed of packages 4.1 and 4.2 constant in spite of the increasing package diameter. For this purpose, contact roll 10 serves to measure the peripheral speed. As best seen in FIG. 2, the contact roll 10 only covers the end areas of the packages 4.1 and 4.2, and it frictionally engages the periphery of the packages. Contact roll 10 is driven by coaxial motor 17 which in turn is connected with the output of frequency converter 33. The power consumption (amperage times voltage) corresponds to the power necessary for driving the contact roll 10, contact roll 11, and all parts connected thereto at a peripheral speed not essentially greater than the peripheral speed of the packages, without having contact between either of the contact rolls 10 or 11 and a package. This means that essentially no driving momentum is transferred by the contact roll 10 to the packages 4.1, 4.2. A measuring device is indicated at 33. This measuring device 33 measures the current or the power used by the coaxial motor 17 of the contact roll 10. Appropriate devices for measuring the current or power are known, note for example German Pat. Nos. 25 35 457 and 26 06 093, and U.S. Pat. No. 4,069,985. The measuring device 33 is connected to the frequency converter 31 by switch 34, to thereby form a closed control circuit.

In the phase of the winding cycle illustrated in FIG. 3, the winding spindle 2.1 mounting the empty tubes 30.1 and 30.2 is driven by switch 38, frequency converter 32 and coaxial drive motor 29 at the maximum driving speed which is determined by the maximum frequency of the frequency converter 32. This maximum speed is such that the peripheral speed of the empty tubes 30.1 and 30.2 essentially corresponds to the peripheral speed of the packages 4.1 and 4.2 and of the contact rolls 10 and 11. It is advantageous if the peripheral speed of the empty tubes is slightly higher, as the removal of the yarns from the full packages 4.1, 4.2, and the application of the yarns to the empty tubes 30.1 and 30.2 will thereby be facilitated. This operation of transferring the yarns is performed with the winding spindles 2.1 and 2.2 being in the illustrated position, and as soon as the yarns are applied to the empty tubes 30.1 and 30.2 and torn off the full packages 4.1 and 4.2, new packages are formed on the empty tubes 30.1 and 30.2. The turret (not shown) is then rotated, so that the circumference of the empty tubes 30.1 and 30.2, i.e. the packages being formed thereon, comes into circumferential contact with the contact roll 11. At the same time, the full packages 4.1 and 4.2 are removed from contact with the contact roll 10. The drive motor 28 is switched out of the control circuit by actuating the switch 34 and switched off by actuating switch 37. Thus, the speed of the winding spindle 2.2 is decelerated by a brake (not shown). It is also possible to decelerate the winding spindle 2.2 electrically by using an appropriate coaxial drive motor 28. As soon as there is a circumferential contact between the empty tubes 30.1 and 30.2, i.e. between the packages being formed thereon, and the contact roll 11, the switch 35 and thus the control circuit is closed which maintains the peripheral speed of the packages being formed constant. Upon the packages being formed on the winding spindle 2.1 having nearly reached the full diameter, the turret is rotated to such an extent that the winding spindle 2.1 reaches the position which is taken by the winding spindle 2.2 shown in FIG. 3. In this position, the packages shown on the winding spindle 2.1 are again in circumferential contact with contact roll 10, while they are no longer in contact with contact roll 11. The transfer of the yarns described above will be then again performed.

Suitable devices for transferring the yarns from the full bobbins to the empty tubes are described, for example in U.S. Pat. No. 3,913,852. Due to the illustrated arrangement of the contact rolls 10 and 11, the drives 28, 29 of the winding spindles may be controlled continuously and also during the phase of the transfer of the yarns so as to obtain the required peripheral bobbin speed.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A yarn winding apparatus for continuously advancing yarns to form yarn packages thereof and comprising a yarn traversing mechanism, a main contact roll, an auxiliary contact roll spaced from said main contact roll, a pair of rotatable winding spindles, and means supporting said pair of winding spindles for successive movement between an operating and doffing position wherein one of said winding spindles is in operative contact with said main contact roll and the other of said winding spindles is positioned out of engagement with both of said contact rolls and in position for yarn packages to be doffed therefrom, and a yarn transfer position wherein one of said winding spindles is in operative contact with said auxiliary contact roll, the auxiliary contact roll being arranged behind the main contact roll, when viewed in the direction of movement of said means supporting said spindles, such that movement of the spindles into said transfer position results in the spindle carrying the full packages losing contact with the main contact roll and coming into contact with the auxiliary contact roll.

2. A winding apparatus according to claim 1 wherein said main contact roll and auxiliary contact roll are driven by a common motor via a transmission providing the same peripheral speed to both of said rolls.

3. A winding apparatus according to claim 2 wherein the spindles are freely rotatably mounted in spindle supporting means and such that said main and auxiliary contact rolls are adapted to drivingly engage each of said spindles.

4. A winding apparatus as defined in claim 1 wherein said spindle mounting means further includes a drive motor drivingly connected to each of said winding spindles.

5. A winding apparatus according to claim 1 wherein said main contact roll and said auxiliary contact roll are positioned so that both of said winding spindles are in operative contact with respective ones of said rolls in said yarn transfer position of said spindle supporting means.

6. A winding apparatus according to claim 1 wherein said main contact roll and said auxiliary contact roll are positioned so that neither one of said winding spindles is in operative contact with said main contact roll in said yarn transfer position of said spindle mounting means.

7. A winding apparatus according to claim 6 wherein said spindle mounting means further includes a drive motor drivingly connected to each of said winding spindles, with each of said drive motors comprising three phase alternating current motors, and further comprising a frequency converter operatively connected to each motor and power measuring means operatively connected between one of said contact rolls and said frequency converters.

8. A winding apparatus according to claim 1 wherein the diameter of said main contact roll is smaller than the diameter of said auxiliary contact roll, and further including a drive motor directly driving one of said contact rolls, and transmission means drivingly connecting said motor with the other contact roll so that the circumferential speed of said contact rolls is the same.

9. A winding apparatus according to claim 8 further including a drive shaft extending outwardly from opposite ends of said drive motor, with said auxiliary contact roll being directly connected to one end of said drive shaft, and wherein said transmission means includes a drive pulley connected to the other end of said drive shaft, a drive pulley directly connected to said main contact roll, and a timing belt drivingly interconnecting said drive pulleys.

10. A winding apparatus according to claim 9 wherein the length of said main contact roll substantially corresponds with the length of said winding spindles, and wherein the length of said auxiliary contact roll is shorter than the length of said main contact roll and is positioned in approximately the longitudinal center area of said main contact roll.

11. A winding apparatus according to claim 10 wherein a pair of adjacent yarn packages are adapted to be wound on each of said winding spindles, and wherein said auxiliary contact roll is adapted to frictionally engage adjacent end portions of the neighboring end areas of the pair of adjacent yarn packages.

12. A winding apparatus according to claim 8 wherein said drive motor is driven with an output speed which corresponds to the no-load output speed of said main and auxiliary contact rolls.

13. A winding apparatus according to claim 1 wherein said means for supporting said winding spindles comprises a rotary turret.

14. A winding apparatus according to claim 1 wherein said yarn traversing mechanism includes counter-rotating rotary blade elements.

15. An apparatus for continuously winding a high speed running yarn or the like onto bobbin tubes serially delivered to a winding position, and comprising a turret rotatably mounting at least two winding spindles, with each spindle adapted to mount at least one bobbin tube, and such that each spindle and associated bobbin tube may be selectively moved between a winding position and a doffing position, means for winding a running yarn onto a bobbin tube at the winding position and including a main contact roll for contacting the surface of such bobbin tube, and traversing means for traversing the running yarn onto the rotating tube to form a cross wound package thereon, an auxiliary contact roll mounted parallel to and laterally spaced from said main contact roll and so as to be spaced from the bobbin tube and associated package at the winding position, drive means operatively interconnecting said main contact roll and said auxiliary contact roll for rotating the same at the same surface speed, and means for selectively rotating the turret so as to move a first spindle and associated full package at the winding station to an intermediate position wherein said full package is in engagement with said auxiliary contact roll and the yarn may be transferred from the full package to an empty bobbin tube mounted on a second winding spindle, and then to said doffing position wherein said full package is free of contact with said auxiliary contact roll and the second spindle and associated empty bobbin tube reaches the winding position in operative contact with said main contact roll.

16. A winding apparatus as defined in claim 15 further comprising a support slide housing mounted for movement along a direction generally parallel to the direction of yarn movement, and wherein said support slide housing mounts said yarn traversing means, said main contact roll, and said auxiliary contact roll.

17. A winding apparatus as defined in claim 16 wherein said turret includes rotational drive means for rotating each of said spindles and associated bobbin tubes.

18. A winding apparatus as defined in claim 17 further including rotational speed sensing means operatively connected to said main and auxiliary contact rolls, and control means operatively connected to said sensing means for controlling the speed of said rotational drive means of said spindles and associated bobbin tubes.

19. A winding apparatus as defined in claim 16 wherein said drive means for said main contact roll and said auxiliary contact roll comprises a common electric motor mounted on said support slide housing.

20. A winding apparatus as defined in claim 15 further comprising drive means for rotating each of said winding spindles shortly prior to each spindle coming into operative contact with said main contact roll.

21. A method for continuously winding a high speed running yarn onto bobbin tubes, and which includes a turret rotatably mounting at least two spindles, with each spindle adapted to mount at least one bobbin tube coaxially thereon, and comprising the steps of rotating the turret so that one of the spindles and associated bobbin tube is brought into contact with a main contact roll, and with the other spindle in a doffing position, rotating the turret to an intermediate position upon the tube of said one spindle becoming a substantially full package, and so that the full package is in contact with an auxiliary contact roll, transferring the yarn from each of the full packages to an empty bobbin tube on said other spindle while the turret is in said intermediate position, then rotating the turret to a further position wherein said one spindle is in the doffing position and said full package is free of contact with the auxiliary roll and said other spindle and empty bobbin tube is in contact with said main drive roll, removing each of the full packages from said one spindle and replacing the same with at least one empty bobbin tube, and cyclically repeating the above steps to continuously wind the running yarn onto a series of bobbin tubes.

22. A method as defined in claim 21 comprising the further step of drivingly rotating each of said spindles of said turret as the turret is rotated and the spindle approaches the main contact roll to initially impart a predetermined rotational speed to the spindle prior to its contact with the main contact roll.

23. A method as defined in claim 21 wherein said other spindle having an empty bobbin thereon is in contact with said main contact roll while said turret is in said intermediate position.

24. A method as defined in claim 21 wherein said other spindle having an empty bobbin thereon is out of contact with said main contact roll while said turret is in said intermediate position, and comprising the further step of rotating said other spindle to a speed closely corresponding to the rotational speed of said main contact roll while said turret is in said intermediate position and prior to the yarn transferring step.

* * * * *